US012037866B2

(12) United States Patent
Halvorsen et al.

(10) Patent No.: US 12,037,866 B2
(45) Date of Patent: Jul. 16, 2024

(54) METHOD AND APPARATUS FOR ALIGNING A SUBSEA TUBING HANGER

(71) Applicant: CONOCOPHILLIPS COMPANY, Houston, TX (US)

(72) Inventors: Eivind C. Eike Halvorsen, Tananger (NO); Leif Kvarme, Tananger (NO); Rune Woie, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 18/056,401

(22) Filed: Nov. 17, 2022

(65) Prior Publication Data

US 2023/0151709 A1 May 18, 2023

Related U.S. Application Data

(60) Provisional application No. 63/264,249, filed on Nov. 18, 2021.

(51) Int. Cl.
*E21B 33/043* (2006.01)

(52) U.S. Cl.
CPC ..... *E21B 33/043* (2013.01)

(58) Field of Classification Search
CPC ..... E21B 33/043
See application file for complete search history.

(56) References Cited

U.S. PATENT DOCUMENTS

| | | | | |
|---|---|---|---|---|
| 4,355,825 | A * | 10/1982 | Leicht | E21B 33/043 285/123.3 |
| 10,605,033 | B2 * | 3/2020 | Levert | E21B 34/02 |
| 2013/0088362 | A1 * | 4/2013 | Yates | E21B 47/13 340/854.3 |
| 2016/0305232 | A1 | 10/2016 | Bird et al. | |
| 2017/0096858 | A1 | 4/2017 | Watters et al. | |
| 2018/0163500 | A1 | 6/2018 | Levert et al. | |
| 2018/0163520 | A1 | 6/2018 | Navar et al. | |
| 2020/0217165 | A1 | 7/2020 | Robottom et al. | |
| 2021/0238937 | A1 | 8/2021 | Mclaughlin et al. | |
| 2021/0285317 | A1 | 9/2021 | Woie et al. | |

FOREIGN PATENT DOCUMENTS

| | | | | |
|---|---|---|---|---|
| WO | 2011018120 | A1 | 2/2011 | |
| WO | WO-2014078094 | A2 * | 5/2014 | E21B 23/00 |
| WO | WO-2022076668 | A1 * | 4/2022 | E21B 19/00 |
| WO | WO-2022133596 | A1 * | 6/2022 | |

OTHER PUBLICATIONS

International Search Report, PCT/US2022/080054 mailed Feb. 17, 2023; 3 pgs.

* cited by examiner

*Primary Examiner* — Aaron L Lembo
(74) *Attorney, Agent, or Firm* — CONOCOPHILLIPS COMPANY

(57) ABSTRACT

The invention relates to the alignment of a tubing hanger (14) when installed in a subsea wellhead (11). Sensors (39*a,b;* 40*a,b*) detect when the orientation is correct and send a signal to the surface to provide positive confirmation of correct orientation, before a XMT (15) is installed on the wellhead (11) and the HP riser (31) removed, etc.

8 Claims, 3 Drawing Sheets

METHOD AND APPARATUS FOR ALIGNING A SUBSEA TUBING HANGER

CROSS-REFERENCE TO RELATED APPLICATIONS

This application is a non-provisional application which claims benefit under 35 USC § 119(e) to U.S. Provisional Application Ser. No. 63/264,249 filed Nov. 18$^{th}$ 2021 entitled "METHOD AND APPARATUS FOR ALIGNING A SUBSEA TUBING HANGER," which is incorporated herein in its entirety.

STATEMENT REGARDING FEDERALLY SPONSORED RESEARCH

None.

FIELD OF THE INVENTION

This invention relates to the installation of a tubing hanger in a Xmas Tree of a subsea installation for the production of hydrocarbons.

BACKGROUND OF THE INVENTION

Establishing a subsea hydrocarbon production well involves locating a template on the seafloor with a number of slots. Drilling into the seafloor is performed through a slot and then a wellhead is installed, and casing suspended from the wellhead. Operations are performed through a marine high pressure riser (HP riser) extending to the surface, with a blow out preventer (BOP) installed either at the subsea wellhead or at the surface. The riser is connected at the subsea end via a riser connector to either the BOP or, if the BOP is at the surface, to the wellhead.

Once the well is fully cased, it is necessary to install production tubing. Production tubing is suspended from a tubing hanger (TH); the tubing hanger being landed on previously installed casing hanger within the wellhead and then locked in place. The orientation of the TH around the vertical well axis is set in this step. A pressure test of the tubing hanger is then performed, and the production packer is set.

With the TH locked in place and tested, the work string including tubing hanger running tool is withdrawn. The BOP and HP riser may then be removed. A subsea vertical Xmas tree system (VXT) is then installed on the wellhead.

The template contains a number (e.g. 4) of slots/wellheads and it is necessary to go through the above steps for each wellhead. Each wellhead will receive a VXT. Located in the template between the VXTs is a production manifold whose purpose is to receive production flow from each VXT once the wells are producing, and to combine these flows into a single line to the host platform.

Each VXT includes a connector known as a production outboard wing hub which, when the VXT and manifold are in place in the template, extends towards the manifold and connects with a corresponding inboard hub on the manifold. Since these hubs comprise steel conduit rigidly connected to the VXT or manifold, respectively, precise alignment between the VXTs and the manifold is critical to ensure a sound connection between the hubs. This alignment is achieved by the VXT and the manifold both being located on template guide posts so that both VXTs and manifold are aligned with respect to the template.

When a VXT is installed, it also interfaces with the tubing hanger to connect with production tubing in the respective slot/wellhead so that it aligns precisely with the production bore and also additional channels/bores/lines around the main bore, in order that the connections are sound and leak-free. The orientation of the TH (around the vertical well axis) is therefore critical since it effectively determines the orientation of the VXT required for a leak-free connection with the production tubing (main bore together with ancillary bores/lines adjacent the main more). The tolerances here are very tight.

Since the orientation of the VXT is determined by the template guide posts, if the TH orientation is not sufficiently precise then the required leak-free connection between VXT and production tubing may not be made. With strict orientation requirements +/−1,5-2 degree from reference point, there is a fairly high risk that the TH can be installed outside given tolerances. If the TH is found to have been installed outside the manufacture's tolerances, the well must be re-worked, and a new completion must be installed.

Currently, orientation checks of the TH can only be done after the HP riser and the Blowout Preventer (BOP) have been removed from the well. Prior to removal of the BOP and riser, the completion needs to be fully set, tested and the well must be suspended with two individual suspension barriers. All these things must be done before any test can be carried out. The estimated duration for such work-over activity is approximately 7 to 10 days with a drilling rig. The estimated cost impact for this activity is around 75 to 100 million Norwegian Kroner (about 7.5 to 10 million US Dollars) at today's prices.

There is therefore a need to improve the precision with which the tubing hanger is installed.

BRIEF SUMMARY OF THE DISCLOSURE

The invention more particularly includes a process for installing a production tubing hanger in a subsea wellhead in a subsea template, the process comprising:

a) running a tubing hanger and tubing hanger running tool through a riser to install the tubing hanger in the wellhead;
b) using a sensor to detect the orientation of the tubing hanger around a vertical axis with respect the template;
c) adjusting the orientation of the tubing hanger with respect to the template; d) installing the tubing hanger.

The invention also includes a system for sensing alignment around a vertical well axis of a tubing hanger with respect to a subsea template, the system comprising:

(a) A sensor pair comprising complementary first and second sensor components;
(b) The said first sensor element located on a riser orientation spool or blowout preventer, the orientation spool including supports for engaging with the template to locate the orientation spool;
(c) The said second sensor element located on a wellhead running tool or wellhead orientation tool;
(d) Said first and/or second sensors being in communication with a display apparatus on the surface, whereby positive confirmation of correct alignment of the tubing hanger running tool may be displayed at the surface.

Various optional features of the invention are described in the dependent claims appended to this document.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
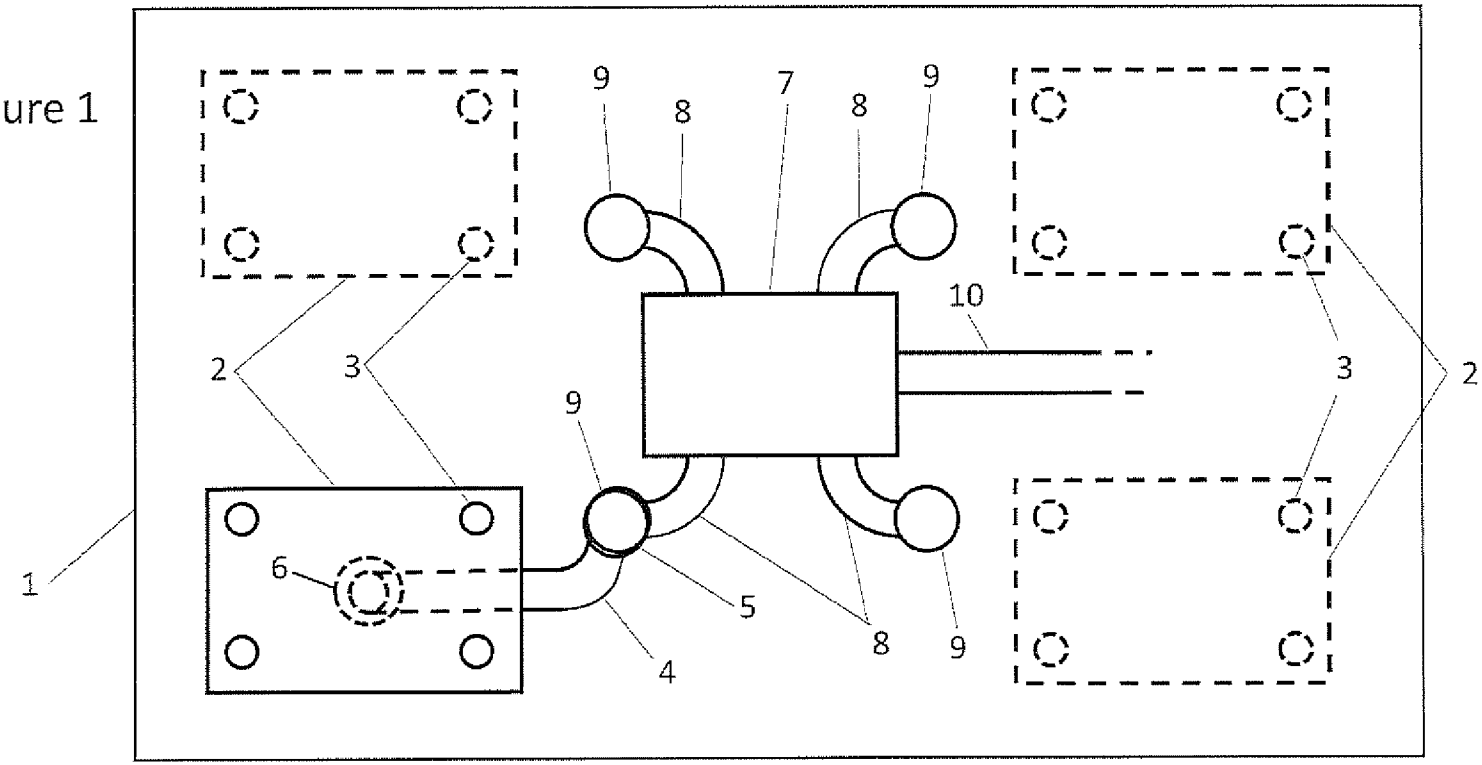
FIG. 1 shows prior art and is a highly schematic plan view of a subsea template with four Xmas trees and a manifold.

FIG. 1 shows prior art and provides background to the invention. On a subsea template 1 are located four vertical Xmas trees (VXTs) 2. Each VXT is located on the template by template guide posts 3. Extending from each VXT is an inboard wing hub 4 (for clarity, this is only shown on the bottom left VXT in FIG. 1) which carries produced oil and gas from the wellhead 6 and terminates in a connector 5.

At the center of the template 1 is a manifold 7. Extending from the manifold 7 are four outboard wing hubs 8 each terminating in a respective outboard wing hub connector 9. In the assembly, the outboard and inboard connectors 5, 9 are secured together such that produced oil and gas flows from all four VXTs to the manifold 7. An output line 10 from the manifold 7 carries produced oil and gas from all four VXTs to a nearby production platform.

The inboard and outboard hubs 4, 8 comprise steel tubing with a large central bore for produced oil and gas and smaller channels and lines (not shown in FIG. 1), e.g. for control or managing pressure in annuli in the producing well. The alignment of the inboard and outboard hub connectors 5, 9 is critical and is ensured by the VXT and manifold both being located by features of the template 1.

Figure 2:
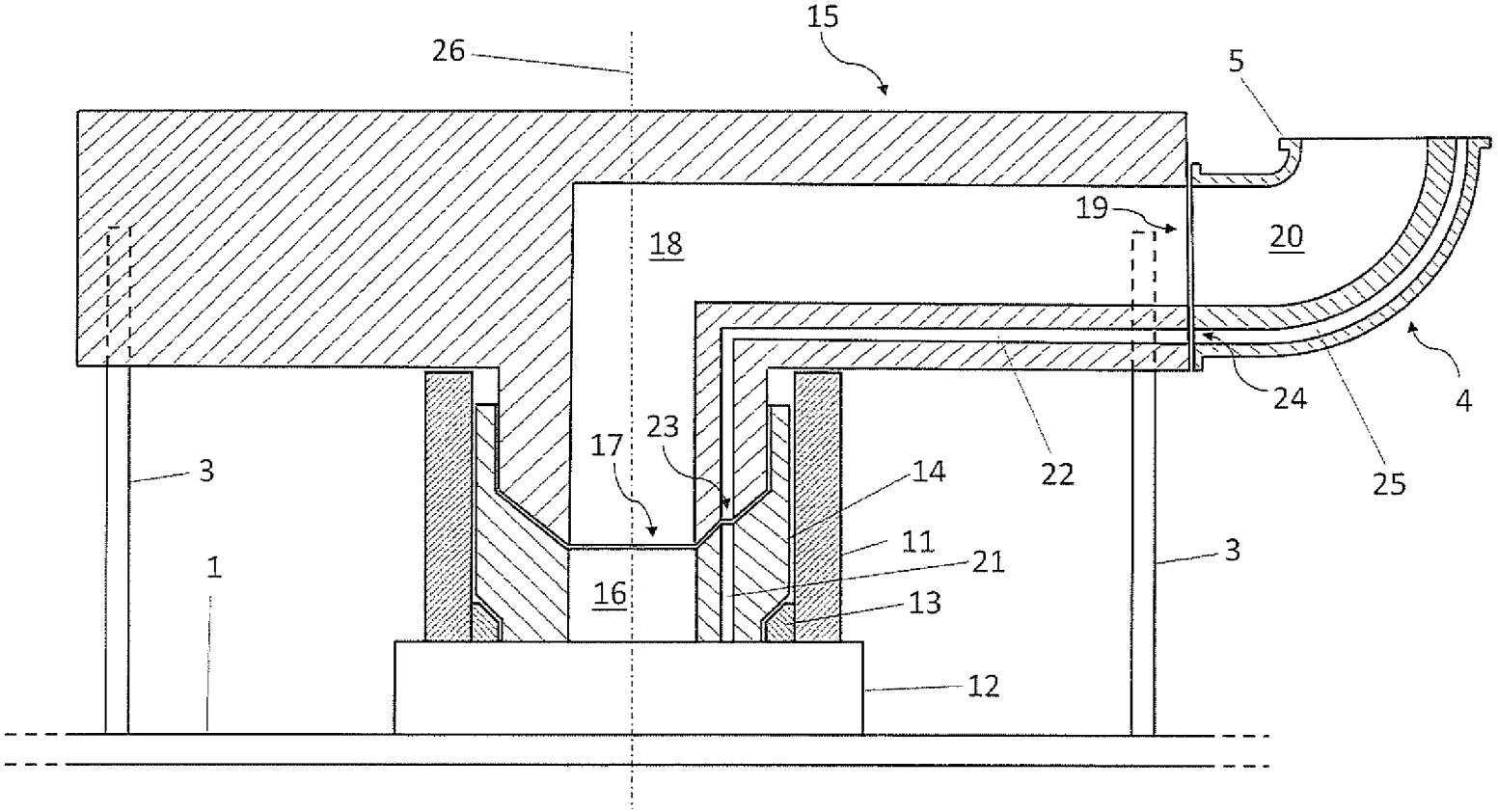
FIG. 2 shows prior art and is a highly schematic sectional view from the side of a wellhead with tubing hanger and Xmas tree installed.

Turning now to FIG. 2, which also shows prior art and provides background to the invention, a wellhead 11 is installed in a slot 12 of a template 1. Installed in the wellhead is a casing hanger 13 and, mounted in the wellhead on the casing hanger, is a tubing hanger 14. Mounted on the wellhead 11 a vertical Xmas tree (VXT)15. The VXT is located with respect to the template 1 by template guide posts 3.

As with the other components, the VXT 15 is shown in highly schematic form and omitting the majority of the features of this complex piece of equipment. Connected to the side of the VXT 15 is an inboard wing hub 4 with connector 5 for interfacing with an outboard wing hub of a manifold (not shown).

The VXT 15 interfaces with the tubing hanger 14 and makes a seal 17 with a main production bore 16 of the tubing hanger 14, such that the main production bore is continued through a VXT main bore 18 and then via a further seal 19 through an inboard hub main bore 20.

Alongside the main production bore 16 are one or more smaller bores, conduits or control lines (hydraulic, electrical, optical, etc.). There may be a number of these located around the main production bore 16 but for clarity only one exemplary TH secondary conduit 21 is shown in FIG. 2. The conduit 21 is continued into a VXT secondary conduit 22 via a seal 23. The VXT secondary conduit 22 is then continued via a seal 24 into an inboard hub secondary conduit 25.

The orientation of the VXT 15 around the vertical axis 26 of the system is clearly critical in order that the secondary conduit seal 23 is not compromised, along with any other conduit seals or connections, e.g. for electrical or optical cable, arranged around the main bore seal 17. Since the VXT's orientation around axis 26 is set with respect to the template 1 by the template guide posts 3 in order that the inboard and outboard hub connectors 5, 9 mate correctly, it is important that the TH 14 is installed in the correct orientation in the wellhead 11 so that the various seals and connections between the VXT and TH are correctly made. In practice, the tolerance here can be as little as 1.5 degree.

FIG. 3 shows the current standard system for orienting the TH, as well as illustrating the invention. In FIG. 3, the VXT has not yet been installed and the TH 14 is in the process of being installed.

The template 1, template slot 12, wellhead 11 and casing hanger 13 are in place. A high pressure riser assembly 30 extends between the wellhead 11 and a blow out preventer (not shown) on a rig (not shown) at the surface. The riser assembly 30 comprises a high pressure riser 31 and a riser orientation spool 32. The orientation spool 32 connects the riser 31 to the wellhead 11, and also includes part of a mechanism, described more fully below, for orienting the tubing hanger 14. The orientation spool 32 includes locating arms 33 which fit onto the template guide posts 3 which will later secure the orientation of the VXT 15.

Within the riser assembly is shown a tubing hanger running tool 34 temporarily secured to the tubing hanger 14, above which is a tubing hanger orientation tool 35. The running tool 34 and orientation tool 35 are suspended from drill string 36.

The TH orientation tool 35 includes a locating groove 37, a helical groove or cam surface which is engaged with a sprung locating pin 38 on the interior surface of the riser orientation spool 32. The purpose of these components will be discussed more fully below.

Located on the interior surface of the riser orientation spool 32 are upper and lower inductive sensors 39*a*, 39*b*. Complementary elements 40*a*, 40*b* are located on the exterior surface of the tubing hanger orientation tool 35 and running tool 34, respectively. The elements 40*a*, 40*b* are inserts made from a different metal to that of the tubing hanger running tool 34 and orientation tool 35. The sensors and complementary elements are precisely located at points on the circumferences of the riser orientation spool 32 and tubing hanger running tool 34 and TH orientation tool 35 such that the orientation of the running tool and orientation tool can be precisely determined with respect to the riser orientation spool, which itself located with respect to the template 1. Lines (not shown) running up the riser or drill string communicate signals from the sensors to monitoring apparatus (not shown) at the surface.

The locations of the inductive sensors 39 and complementary elements 40 may be varied. For example, the sensors 39 may be located on the TH running tool 34 and/or orientation tool 35 and the complementary elements on the inside of the riser orientation spool 32. It may be possible to have both the inner elements located on one or the other of the running tool 34 and orientation tool 35. If a subsea blowout preventer (BOP) is used, then the outer elements may be located on the BOP. Other possibilities may become apparent to the skilled person depending on the details of the work string and riser; the precise location of the sensors in a vertical direction is not critical. The type of sensor is not critical and other types of sensors, e.g. radioactive emitters and complementary absorbers, may be employed.

Figures 3A, 3B:
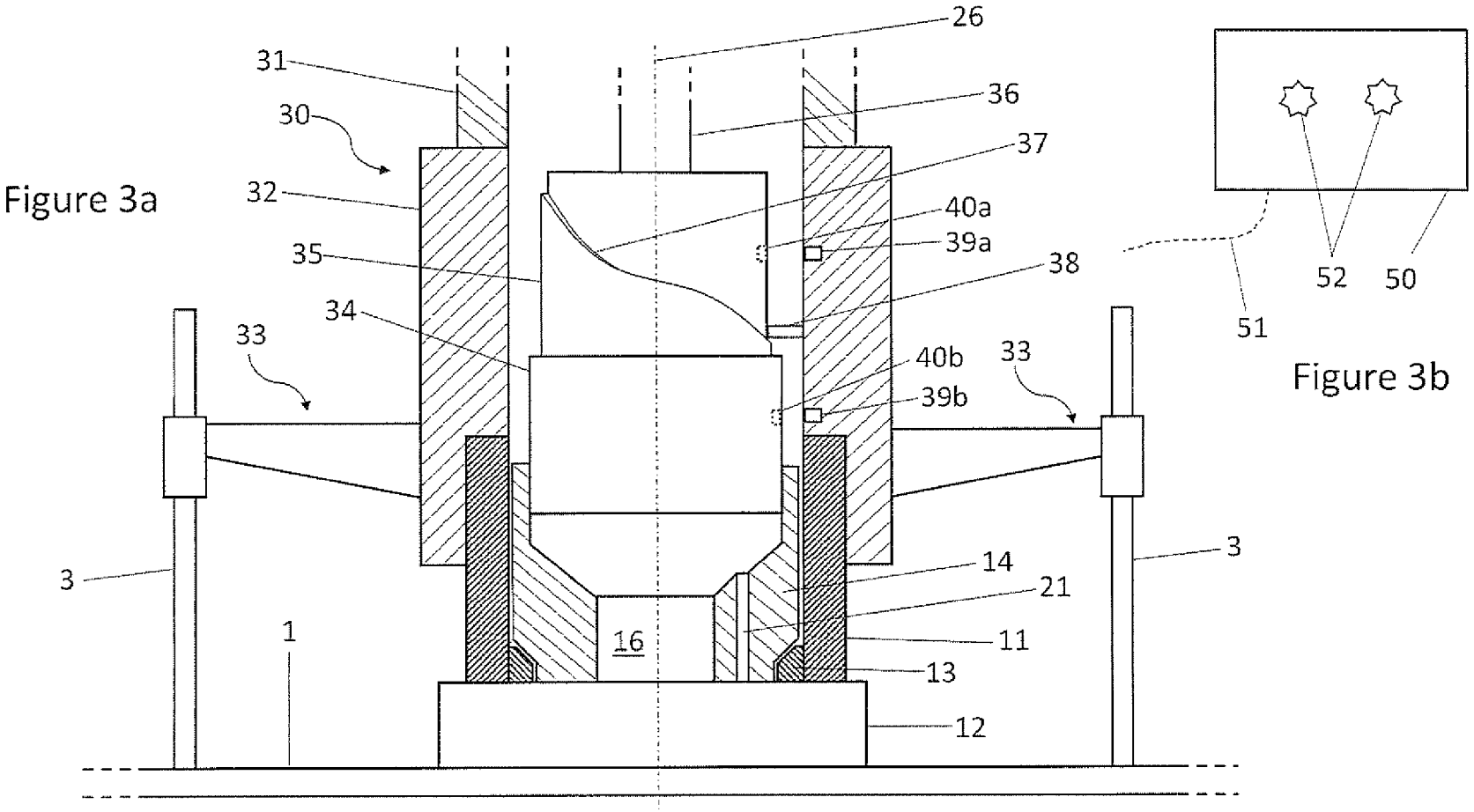
FIG. 3*a* is a highly schematic sectional view from the side of a wellhead with a tubing hanger in the process of being installed, also showing tubing hanger running tool and orientation system together with high pressure riser orientation spool.
FIG. 3*b* is a highly schematic view of a monitoring unit located on the surface.

A simple display unit 50 on the surface, including red and green lights 52, is provided to indicate to the operator that the correct alignment has been achieved and the TH can be locked in place (see FIG. 3*b*). The display unit 50 communicates with the sensors 39,40 via a line 51 In this way, the orientation of the TH is subject to a positive confirmation based on live sensed data before the TH is set and before conducting the lengthy procedures of removing the BOP and riser and installing the XMT.

The current standard procedure (prior art) is to rely on the locating pin 38 and groove 37 to achieve correct orientation of the tubing hanger 14. The running tool, orientation tool and TH assembly is calibrated on the surface with a dummy wellhead and riser to help ensure the components will be correctly aligned when they are installed on the real wellhead.

As the TH running tool string is lowered into the wellhead 14, the pin 38 on the riser orientation spool 32 engages with the groove 37 and rotates the work string until the tubing hanger is in the correct orientation around axis 26 and the various lines and channels (e.g. 21) are correctly located around the axis 26.

Following installation of the tubing hanger, the HP riser 30 and blow out preventer (not shown) are removed and the wellhead prepared to receive a VXT. The rig is then moved away and a VXT installed normally using a vessel. These processes are complex and time consuming, taking up a number of days of expensive rig time. When the VXT is installed and tested it may become apparent that the TH is not properly aligned around the vertical axis 26 for some reason, and one or more of the connections between the various ancillary channels and lines (e.g. 21) adjacent the production bore 16 has not been securely made. The only way to remedy this is to remove the VXT, bring the rig back in and re-install the HP riser assembly 30, run the TH running tool 34 and orientation tool 35 again and adjust the position of the tubing hanger 14. This takes many days of expensive rig time and may even need to be repeated if the alignment is still not correct. Unfortunately, the need for this remedial process is not uncommon.

In the apparatus shown in FIG. 3, the probability of having to perform this extensive remedial process is reduced by having the proximity sensors 39 a,b to provide feedback about the orientation of the TH running tool and orientation tool 34, 35 with respect to the riser orientation spool 32 and hence the template 1. If the orientation of the TH running string appears to be incorrect then the string may be withdrawn slightly and reinserted until the sensors indicates that the orientation is correct. This is a simple and inexpensive procedure which may easily be repeated many times until the correct orientation is confirmed. The HP riser assembly 30 may then be removed and the VXT installed.

With sensors in place, there may be no need to use a TH orientation tool 35 and alignment pin 38, thus saving cost. There may also be no need to have a calibration process and dummy wellhead on the surface, thus saving time and cost.

Instead, the TH running string may simply be rotated from the surface until the sensors indicate that the tubing hanger is correctly oriented before securing the TH and removing the running string.

In modifications of this embodiment more or fewer sensors may be used and the sensors may be of different type. The lower down the sensor, i.e. the nearer the tubing hanger itself, the better since the sensor reading will be less subject to error due to tolerances in connections between components. Clearly if the TH orientation tool 35 is omitted then a sensor on the orientation tool would not be required. Sensors may be provided at more than one location around the circumference. The sensors may be capable of transmitting data to the surface by radio transmission, thereby avoiding the need to run lines down the riser.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for installing a production tubing hanger in a subsea wellhead in a subsea template, the process comprising:

a) running a tubing hanger and tubing hanger running tool through a riser to install the tubing hanger in a subsea wellhead;

b) using a sensor to detect the orientation of the tubing hanger around a vertical axis with respect to a subsea template;

c) adjusting the orientation of the tubing hanger with respect to the subsea template;

d) installing the tubing hanger;

wherein an approximate alignment of the tubing hanger with the template is achieved using a pin and complementary groove located respectively on a riser orientation spool or blow out preventer and a tubing hanger orientation tool.

2. The process according to claim 1, wherein the sensor comprises a complementary pair of first and second elements, the first element being located with respect to a riser orientation spool or blow out preventer and the second element being located with respect to the tubing hanger or tubing hanger running tool or a tubing hanger orientation tool.

3. The process according to claim 1, wherein the sensor comprises an inductive sensor pair, such as an inductive sensor and complementary metallic element.

4. Then process according to claim 1, wherein the sensor provides a positive confirmation of the tubing hanger being correctly oriented with respect to the template prior to removal of a riser and blow out preventer.

5. The process according to claim 1, wherein signals from the sensor are sent via wireless transmission or via a line passing up the riser to monitoring equipment on the surface.

6. The process according to claim 1, wherein the orientation of the wellhead determines orientation of a subsea Xmas tree located on the wellhead.

7. A system for sensing alignment around a vertical well axis of a tubing hanger with respect to a subsea template, the system comprising:

(a) a sensor pair comprising complementary first and second sensor components;

(b) the said first sensor element located on a riser orientation spool or blowout preventer, the orientation spool including supports for engaging with a subsea template to locate the orientation spool;

(c) the said second sensor element located on a wellhead running tool or a wellhead orientation tool;

(d) said first and/or second sensors being in communication with a display apparatus on the surface, whereby positive confirmation of correct alignment of the tubing hanger running tool may be displayed at the surface;

wherein a pin and complementary groove are located respectively on a riser orientation spool or blow out preventer and a tubing hanger orientation tool, whereby at least approximate alignment may be achieved.

8. The system according to claim 7, wherein the sensor pair comprises an inductive sensor and complementary metallic element.

* * * * *